US009254905B1

(12) United States Patent
Randolph et al.

(10) Patent No.: US 9,254,905 B1
(45) Date of Patent: Feb. 9, 2016

(54) COOLING FLUID PUMP FOR COOLING A MARINE ENGINE

(71) Applicant: Brunswick Corporation, Lake Forest, IL (US)

(72) Inventors: Ronnie E. Randolph, Fond du Lac, WI (US); Roger W. Schreiber, Fremont, WI (US)

(73) Assignee: Brunswick Corporation, Lake Forest, IL (US)

( * ) Notice: Subject to any disclaimer, the term of this patent is extended or adjusted under 35 U.S.C. 154(b) by 460 days.

(21) Appl. No.: 13/772,088

(22) Filed: Feb. 20, 2013

(51) Int. Cl.
*F04D 29/44* (2006.01)
*B63H 21/38* (2006.01)
*B63H 20/28* (2006.01)

(52) U.S. Cl.
CPC ..... *B63H 21/383* (2013.01); *B63H 20/28* (2013.01)

(58) Field of Classification Search
CPC ..... B63H 21/383; B63H 20/28
USPC ..... 415/204; 440/88 C
See application file for complete search history.

(56) References Cited

U.S. PATENT DOCUMENTS

| | | | | |
|---|---|---|---|---|
| 1,028,722 | A | 6/1912 | Hess | |
| 4,392,779 | A | 7/1983 | Bloemers et al. | |
| 4,465,428 | A | 8/1984 | Lindberg | |
| 4,685,865 | A | 8/1987 | Auschrat | |
| 4,728,306 | A | 3/1988 | Schneider | |
| 4,741,715 | A | 5/1988 | Hedge | |
| 4,897,059 | A | 1/1990 | Newman | |
| 5,762,104 | A | 6/1998 | Green et al. | |
| 6,004,175 | A | 12/1999 | McCoy | |
| 6,135,064 | A | 10/2000 | Logan et al. | |
| 6,379,201 | B1 | 4/2002 | Biggs et al. | |
| 6,390,870 | B1 | 5/2002 | Hughes et al. | |
| 6,821,171 | B1 | 11/2004 | Wynveen et al. | |
| 7,114,469 | B1 | 10/2006 | Taylor | |
| 7,264,443 | B2 * | 9/2007 | Rozario et al. | 415/206 |
| 7,329,162 | B1 | 2/2008 | Caldwell et al. | |
| 7,476,135 | B2 | 1/2009 | Caldwell et al. | |
| 7,585,196 | B1 | 9/2009 | Jaeger | |

* cited by examiner

*Primary Examiner* — Ching Chang

(74) *Attorney, Agent, or Firm* — Andrus Intellectual Property Law, LLP

(57) ABSTRACT

A cooling fluid pump is for a cooling a marine engine. The cooling fluid pump comprises a pump chamber that contains an impeller. An upstream inlet passage supplies cooling fluid to the pump chamber. A downstream outlet passage discharges cooling fluid from the pump chamber. An impeller shaft rotates the impeller, causing flow of cooling fluid through the pump chamber from the inlet passage to the outlet passage. A drain passage connects the pump chamber to the inlet passage such that at least when the impeller is not rotating, the drain passage drains cooling fluid that settles by gravity in the pump chamber back to the inlet passage.

20 Claims, 7 Drawing Sheets

COOLING FLUID PUMP FOR COOLING A MARINE ENGINE

FIELD

The present disclosure relates to cooling systems for marine vessels, and more particularly to cooling fluid pumps for cooling a marine engine.

BACKGROUND

U.S. Pat. Nos. 7,476,135 and 7,329,162, which are incorporated herein by reference, disclose cooling systems for a marine vessel, which are configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

U.S. Pat. No. 7,585,196 which is incorporated herein by reference discloses a cooling system for a marine propulsion device that provides a transom opening that is sufficiently low with respect to other components of the marine propulsion device to allow automatic draining of all cooling water from the system when the marine vessel is removed from the body of water in which it had been operating. The engine cooling passages and other conduits and passages of the cooling system are all located at positions above the transom opening. The system provides automatic draining for a marine cooling system that is an open system and which contains no closed cooling portions.

U.S. Pat. No. 7,114,469, which is incorporated herein by reference discloses a cooling system for a marine engine which divides a flow of cooling water into first and second streams downstream of a pump. The first stream flows through a first cooling system which is controlled by a pressure sensitive valve. The second stream flows through a second cooling system which is controlled by a temperature sensitive valve.

U.S. Pat. No. 6,821,171, which is incorporated herein by reference discloses a cooling system for a marine engine which conducts water from a coolant pump through the cylinder head and exhaust conduit prior to conducting the cooling water through the cylinder block. This raises the temperature of the water prior to its entering the cooling passages of the cylinder block.

U.S. Pat. No. 6,135,064 which is incorporated herein by reference discloses an engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 6,390,870 which is incorporated herein by reference discloses a draining system for a marine propulsion engine which is provided in which a manifold is located at a low portion of the cooling system to allow all of the water within the cooling system to drain through a common location, or manifold. A rigid shaft is connected to a valve associated with the manifold and extended upwardly from the manifold to a location proximate the upper portion of the engine so that a marine vessel operator can easily reach the upper end of the shaft and manipulate the shaft to open the valve of the manifold. In this way, the valve can be opened to allow all of the water to drain from the engine without requiring the marine vessel operator to reach toward locations at the bottom portion of the engine.

U.S. Pat. No. 6,379,201 which is incorporated herein by reference discloses a marine engine cooling system provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 4,897,059 which is incorporated herein by reference, discloses a corrosion resistant coolant pump for placement in the cooling system of a marine drive, which includes a corrosion resistant member mounted to and rotatable with a drive shaft interconnected with and rotatable in response to the engine crankshaft. The corrosion resistant member is preferably a cup adapted for receiving and enclosing an end of the drive shaft, with a portion of the cup extending into a cavity formed in the coolant pump housing. The cavity is in communication with marine drive cooling system. An impeller is connected to the cup and housed within the cavity for pumping coolant through the system. The cup is interconnected with the drive shaft so as to be rotatable in response thereto, thereby driving the impeller in response to rotation of the drive shaft. A sealing mechanism is provided about the cup for sealing the cavity and preventing contact of coolant with the drive shaft. With this construction, a carbon steel drive shaft can be utilized in a salt water coolant environment, thereby eliminating the need for constructing the entire drive shaft of a corrosion resistant material.

U.S. Pat. No. 4,741,715 which is incorporated herein by reference discloses a pressure actuated drain valve for automatically draining the cooling water from a marine drive engine when the engine is stopped. The drain valve includes a spring-loaded diaphragm which moves to a closed position when the engine water pump is operating to close an outlet from the engine cavities to be drained. The diaphragm automatically moves to its open position when the engine water pump is off to open the outlet to allow cooling water to drain from the engine cavities.

U.S. Pat. No. 4,728,306 which is incorporated herein by reference discloses a marine propulsion auxiliary cooling system is provided by an electric auxiliary water pump pumping sea water to cool the engine and/or fuel line after turn off of the engine to prevent vaporization of the fuel, or in response to another given engine condition.

U.S. Pat. No. 4,392,779 which is incorporated herein by reference discloses marine drives having water cooled engines utilize a water pump mounted over the drive shaft and internal to the drive shaft housing to provide engine cooling, the pump having stamped metal housing parts and a flexible impeller.

SUMMARY

This Summary is provided to introduce a selection of concepts that are further described herein below in the detailed description. This Summary is not intended to identify key or essential features of the claimed subject matter, nor is it intended to be used as an aid in limiting the scope of the claimed subject matter.

In some examples, a cooling fluid pump is for cooling a marine engine. The cooling fluid pump comprising a pump chamber that contains an impeller; an upstream inlet passage that supplies cooling fluid to the pump chamber; a downstream outlet passage that discharges cooling fluid from the pump chamber; an impeller shaft that rotates the impeller, wherein rotation of the impeller causes flow of cooling fluid through the pump chamber from the inlet passage to the outlet passage; and a drain passage that connects the pump chamber to the inlet passage such that at least when the impeller is not rotating, the drain passage drains cooling fluid that settles by gravity in the pump chamber back to the inlet passage.

In other examples, the cooling fluid pump comprises an upstream inlet passage comprising an inlet volute that supplies cooling fluid to a pump chamber in which an impeller is driven into rotation by an impeller shaft to pump cooling fluid to a downstream outlet passage comprising an outlet volute that discharges the cooling fluid. The inlet volute and outlet volute are stacked with respect to an axis along which the impeller shaft extends. A drain passage extends from an upstream end of the outlet volute to a downstream end of the inlet volute and is sloped so as to drain cooling fluid that settles by gravity in the pump chamber back to the inlet passage.

BRIEF DESCRIPTION OF THE DRAWINGS

Examples of cooling fluid pumps for cooling marine engines are described with reference to the following drawing figures. The same numbers are used throughout the figures to reference like features and components.

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
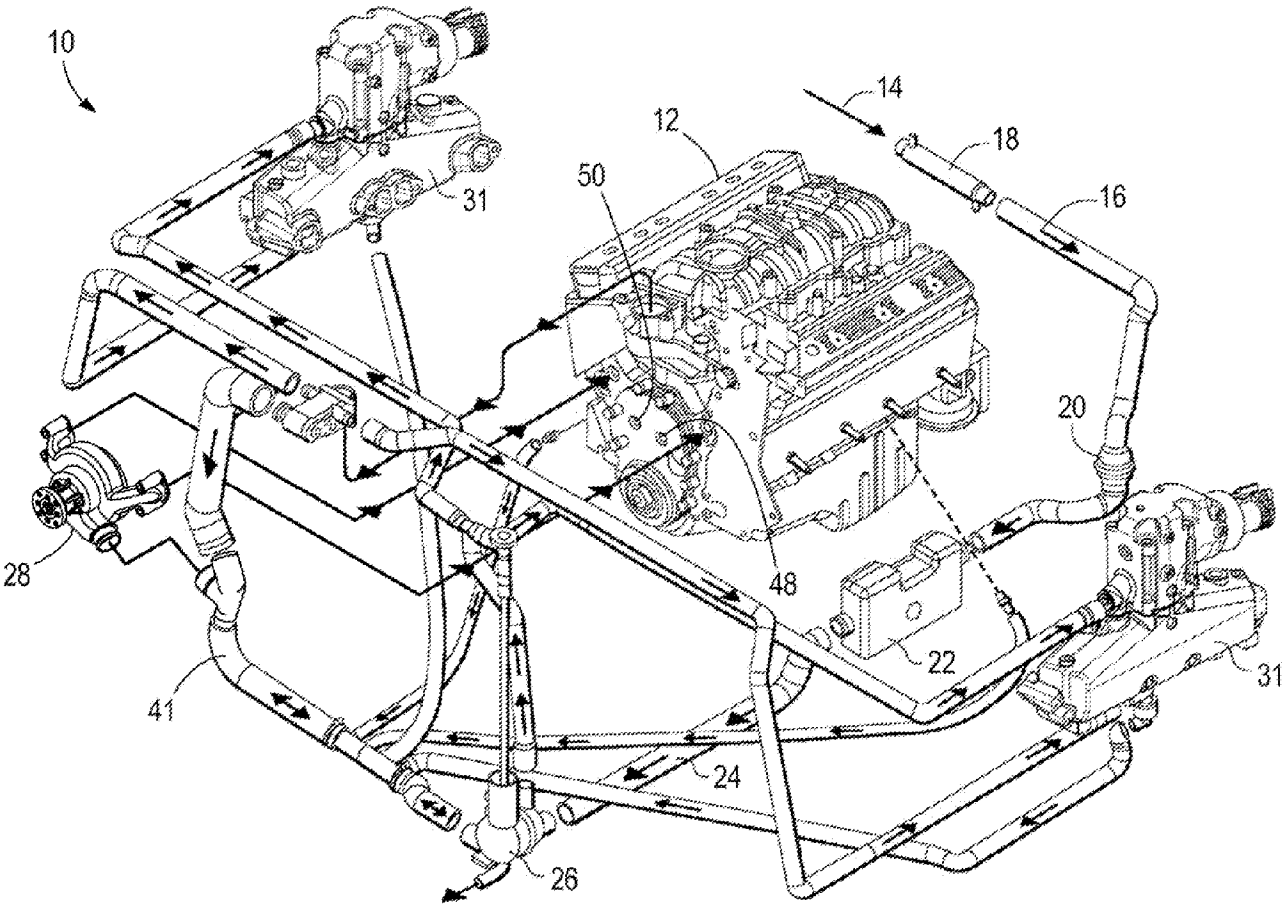
FIG. 1 is an isometric view of a cooling system.
Figure 2:
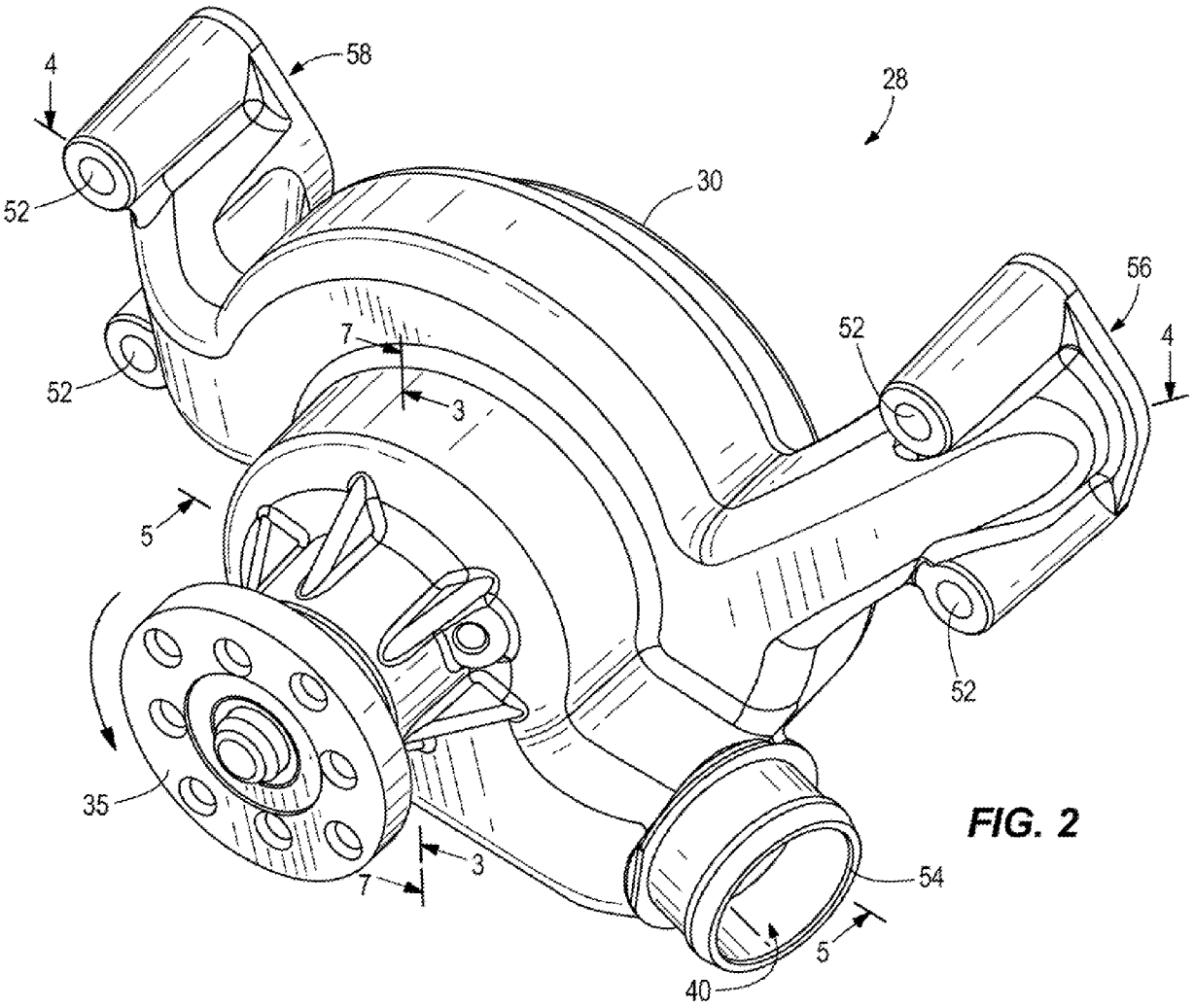
FIG. 2 is an isometric view of a cooling fluid pump that is part of the cooling system.

FIG. 1 is a cooling system 10 for cooling a marine engine 12. Cooling fluid, in this example water, is drawn from a body of water, as schematically represented by arrow 14, and directed through an inlet conduit 16. In the example shown, the water is directed through a power steering cooler 18, a check valve 20, and a fuel cooler 22. The water continues through conduit 24 to a distribution housing 26. Thereafter, water is pumped to the marine engine 12 by a cooling fluid pump, in this example a water circulating pump 28, which is further described in detail herein below. After cooling the engine 12, typically at least some of the water that is circulated through the conduits shown in FIG. 1 is injected into an exhaust stream flowing from exhaust manifolds 31 and then returned to the body of water through a drive unit attached to the transom of the marine vessel. The water conveyed through the engine 12 removes heat from heat emitting components of the engine 12. Water flowing through the conduits in FIG. 1 also removes heat from various other components, such as the power steering cooler 18 and the fluid cooler 22. Other components can also or alternatively be connected in thermal connection with the water in other applications.

FIGS. 2-7 depict the water circulating pump 28 in more detail. The pump 28 has a body 30 that defines a pump chamber 32. An impeller 34 is disposed in the pump chamber 32 and is fixedly connected to one end of a rotatable impeller shaft 36 that extends along an axis P. The opposite end of the impeller shaft 36 extends out of the body 30 and is connected to a drive plate 35. The drive plate 35 is rotated in a conventional manner by a motor-driven pulley (not shown). Rotation of the drive plate 35 causes rotation of the impeller shaft 36 and also the impeller 34.

Referring to FIGS. 1-7, the pump 28 has an inlet passage 40 that receives cooling water from the inlet conduit 41 of the cooling system 10 and also has first and second outlet passages 44, 46 that are respectively connected to cooling water conduits 48, 50 on the engine 12. Mounting holes 52 are provided through the body 30 of the pump 28 at the location of the first and second outlet passages 44, 42 for securing the pump 28 to the engine 12 via connectors, e.g. bolts (not shown). In use, rotation of the impeller 34 reduces the pressure at the inlet passage 40 and increases the pressure at the first and second outlet passages 44, 46, thus causing flow of water through the pump chamber 32 from the upstream inlet passage 40 to the downstream first and second outlet passages 44, 46.

In this example, the inlet passage 40 has an inlet opening 54 located downstream of the inlet conduit 41. The outlet passages 44, 46 have respective outlet openings 56, 58. As shown for example in FIG. 3, the inlet opening 54 of the inlet passage 40 is located vertically lower than the outlet openings 56, 58 of the outlet passages 44, 46. The inlet opening 54 also slopes vertically downwardly away from the pump 28 to the conduit 41 so as to effectively drain cooling water away from inlet passage 40 to the inlet conduit 41 when the impeller 34 is not rotating and the pressure at the inlet passage 40 is at or near ambient. The inlet opening 54 has the shape of an inlet volute having a wide inlet end 55 that gradually tapers into a narrow outlet end 57 (see FIG. 5). The outlet openings 56, 58 of the first and second outlet passages 44, 46 have the shape of outlet volutes having narrow inlet ends 59 that gradually taper into wider outlet ends 61 (see FIG. 4).

Figure 3:
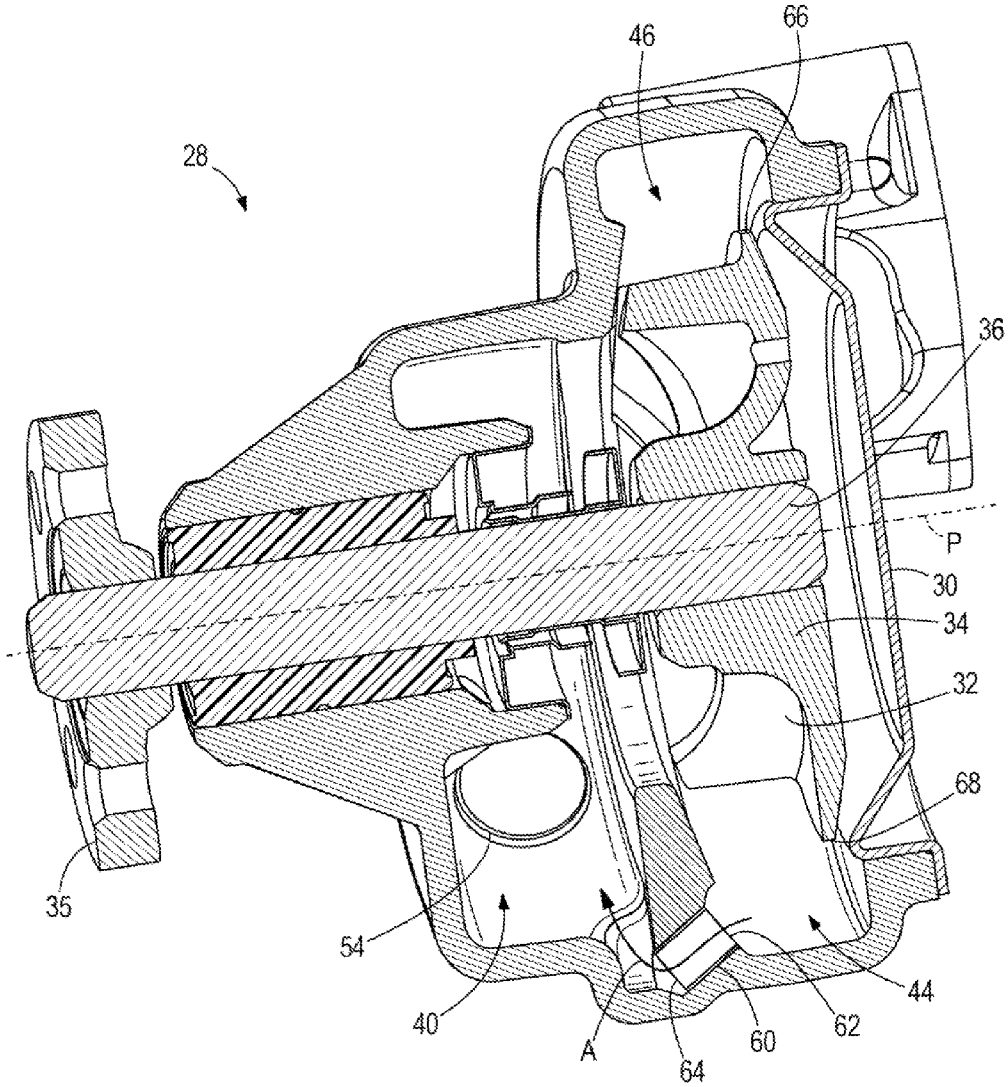
FIG. 3 is a section view of the pump.
Figure 4:
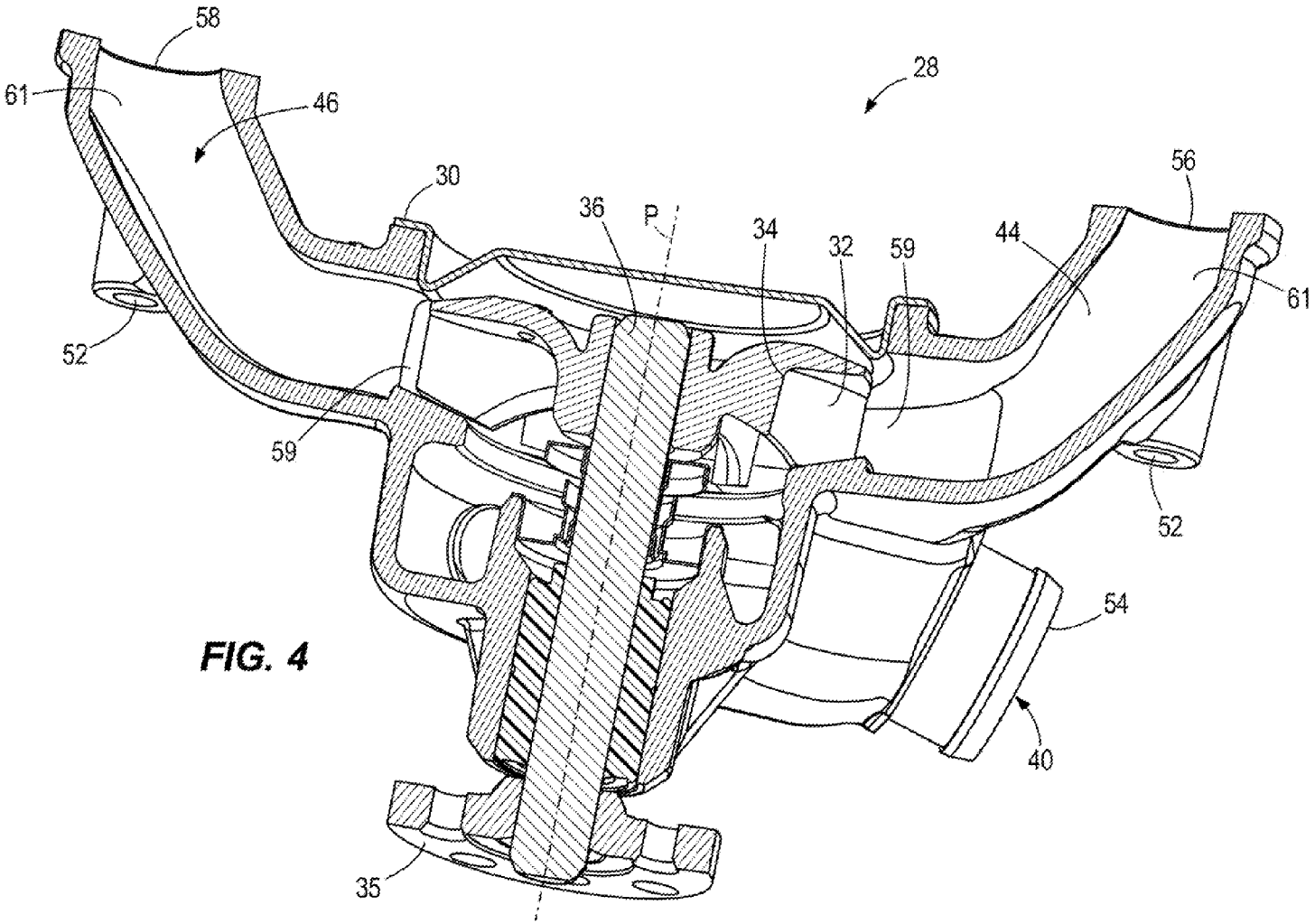
FIG. 4 is a section view of the pump.
Figure 5:
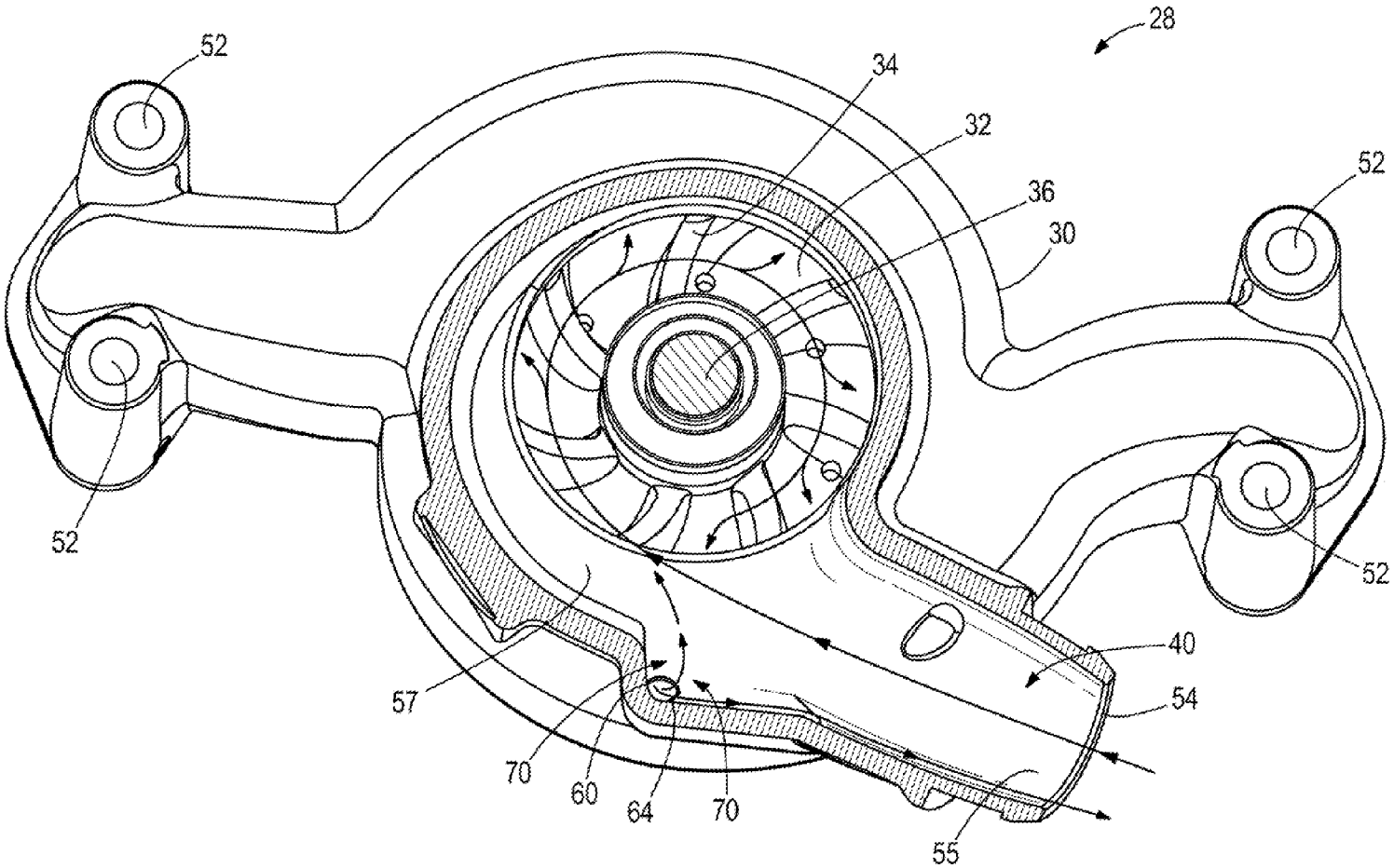
FIG. 5 is a section view of the pump.
Figure 6:
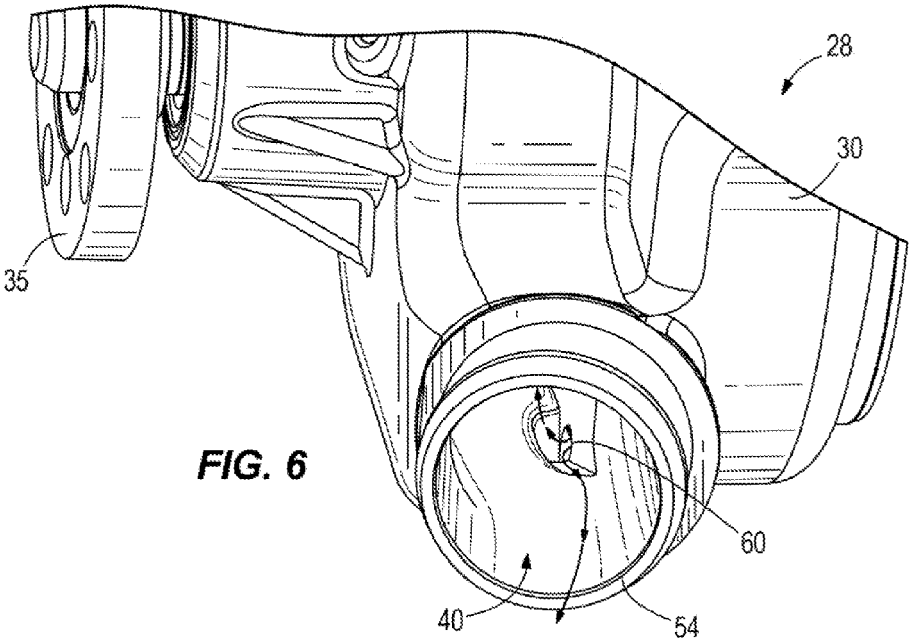
FIG. 6 is a view of an upstream inlet passage of the pump.
Figure 7:
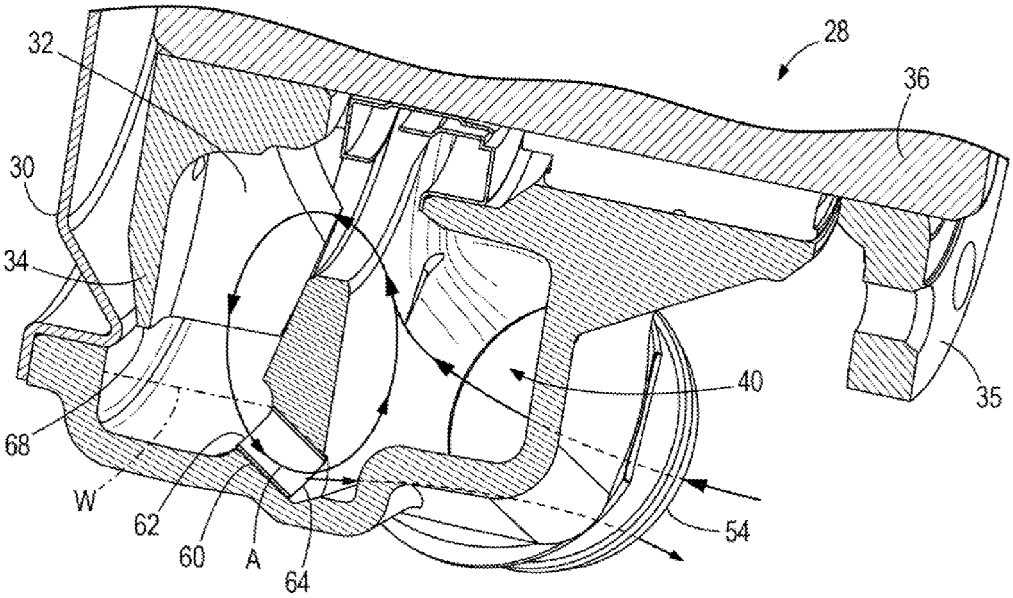
FIG. 7 is a section view of the pump.

A drain passage 60 connects the chamber 32 to the inlet passage 40 such that, at least when the impeller 34 is not rotating, the drain passage 60 drains cooling water that settles by gravity in the chamber 32 back to the inlet passage 40, as shown by arrows A in FIGS. 3 and 7. Additional functionality of the drain passage 60 will be described further herein below. The structural configuration of the drain passage 60 and orientation of the drain passage 60 with respect to the pump 28 can vary from what is shown in the drawings. In the example shown, the drain passage 60 has a drain inlet opening 62 and a drain outlet opening 64. The drain inlet opening 62 is located at and/or opens into the pump chamber 32. The drain outlet opening 64 is located at and/or opens into the inlet passage 40. The shape and orientation of the drain inlet opening 62 and drain outlet opening 64 can vary from what is shown in the drawings. In this example, the drain inlet opening 62 and drain outlet opening 64 both have circular cross sections. The size of the cross sections must be chosen so as not to create a flow imbalance in the pump 28. The present inventors conducted a computational fluid dynamics analysis on one design, which showed a loss of flow on the order of 15% with a drain outlet opening 64 cross section of 6 mm. However actual testing surprisingly indicated the loss to be no greater than 7% and typically 5-6%. This was believed to be because of the non-linear behavior of the pump 28 output relative to restriction against the pump 28.

In some examples, the drain passage 60 can be made of a different material than the pump body 30 and chamber 32. For example, the body 30 can be made of cast iron, whereas the drain passage 60 can be made of brass or stainless steel. This helps maintain the structure and orientation of the drain passage 60 during its operational life.

The location of the drain inlet opening 62 in the pump 28 can vary from what is shown and can be specifically selected so as to facilitate efficient draining of water from the pump 28. In this example, the outer surface of the impeller 34 has a circumferential upper end 66 and a circumferential lower end 68 (see FIGS. 3 and 7). The drain inlet opening 62 of the drain passage 60 is vertically located at or below the circumferential lower end 68 of the impeller 34 (as shown in FIGS. 3 and 7), thus facilitating drainage of water W (shown in dashed line format in FIG. 7) from the chamber 32 when the impeller 34 is not operating to a level that is at or below the circumferential lower end 68 of the impeller 34. Thus if the pump 28 remains dormant in freezing temperatures, frozen water residing in the chamber 32 will not negatively impact or prevent rotation of the impeller 34 at startup. This advantageously protects the pump 28 and related accessories, including the motor-driven pulley, etc. and from freeze damage.

As discussed herein above, operation of the impeller 34 increases pressure at the outlet passages 44, 46 and decreases pressure at the inlet passage 40. Through experimentation, the inventors have found that when the impeller 34 is rotating, water flows out of the pump 28 through the first and second outlet passages 44, 46, as intended, but also sometimes can flow through the drain passage 60 from the inlet opening 62 to the outlet opening 64 (see FIG. 7). This can undesirably yield a reduction in flow rate to one or more of the outlet passages 44, 46 and potentially yield a flow imbalance to the outlet passages 44, 46. The inventors thus endeavored to resolve this inefficiency.

In one non-exclusive example, the drain inlet opening 62 of the drain passage 60 is oriented towards or facing downstream of the pump chamber 32, i.e. towards the first outlet passage 44 and at an angle that is less than 90 degrees. This orientation of the drain inlet opening 62 advantageously limits the amount of water that enters the drain passage 60 during operation of the impeller 34.

In another non-exclusive example, the drain passage 60 connects the narrow inlet end 59 of the outlet volute to the wide inlet end 55 of the inlet volute. A recess 70 is formed in the inlet passage 40 and the drain outlet opening 64 of the drain passage 60 is located in the recess 70 (see FIG. 5). The recess 70 advantageously facilitates improved drainage toward the inlet opening 54 when the impeller 34 is not operational and also facilitates dispersion of drained water into the inlet flow of cooling water through inlet passage 40 during operation of the impeller 34.

In FIGS. 1-7, it will thus be seen that the pump 28 has the upstream inlet passage 40 with an inlet volute that supplies cooling water to the chamber 32 in which the impeller 34 is driven into rotation by the impeller shaft 36 to pump cooling fluid to the downstream outlet passages 44, 46, each having an outlet volute that discharges the cooling fluid. The inlet volute and outlet volute are stacked with respect to each other along the axis P along which the impeller shaft 36 extends. The drain passage 60 extends from the upstream end 59 of the outlet volute to the downstream end 57 of the inlet volute and is sloped so as to drain cooling fluid that settles by gravity in the pump chamber 32 back to the inlet passage 40.

Figure 8:
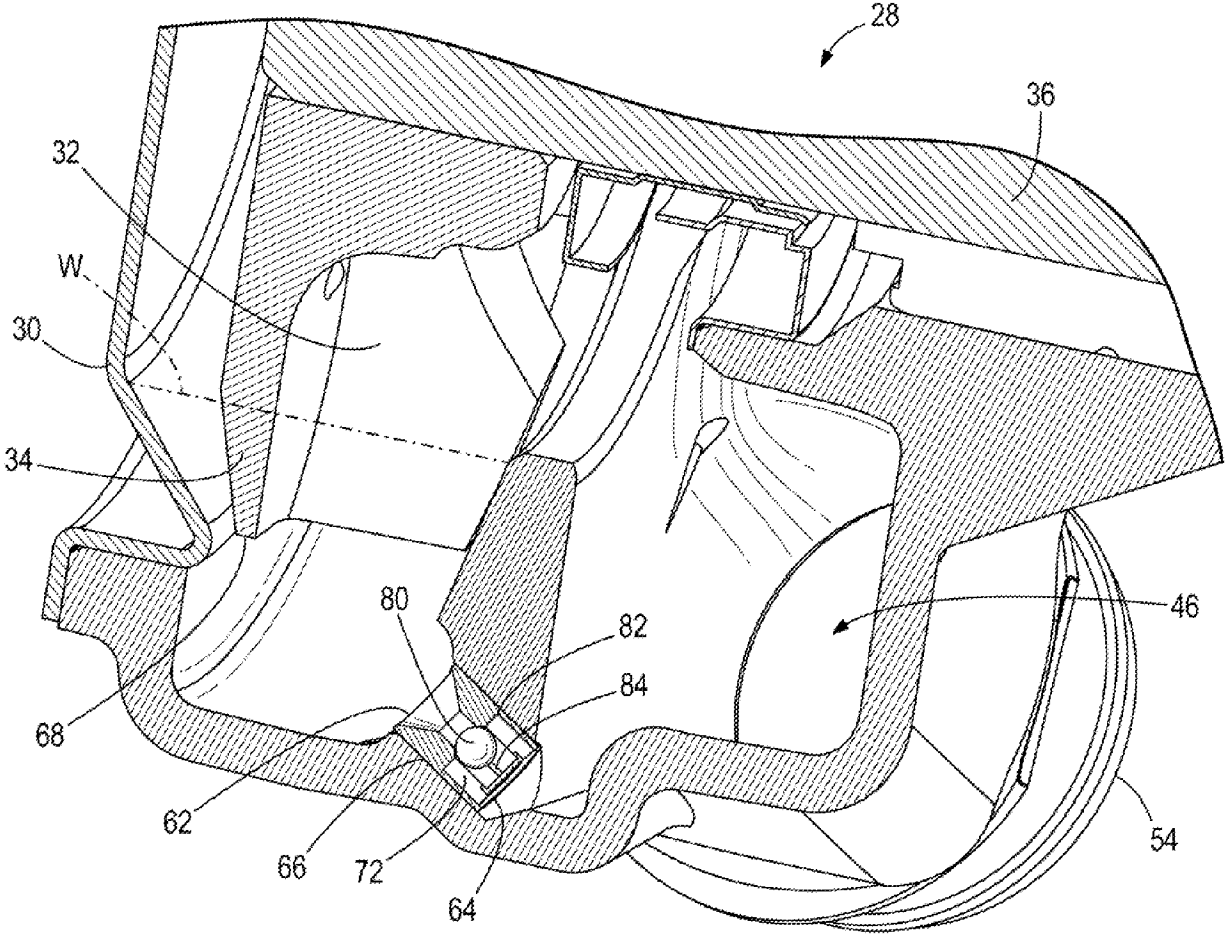
FIG. 8 is a section view of another example of the pump.

In a further non-exclusive example, shown in FIG. 8, an optional check valve 72 is provided in the drain passage 60. The check valve 72 is configured to open and close based upon differences between the relative pressures at the outlet passages 44, 46 and the inlet passage 40. When the impeller 34 is not rotating, the pressure at the inlet is near ambient and the check valve 72 remains open, thus facilitating drainage of cooling water from the chamber 32. When the impeller 34 is rotating, pressure at the inlet passage 40 is decreased, thus causing the check valve 72 to close. This prevents cooling water from entering the outlet opening 64 of the drain passage 60. The check valve 72 can be configured in many different ways, including spring-biased configurations or a pressure-biased configuration. In this non-limiting example, the check valve 72 is shown in the closed position, wherein a relative difference in pressure between the chamber 32 and inlet passage 40 causes a ball 80 to seat against a ball seat 82, thus closing the inlet passage 40 and preventing flow of water therethrough. When the impeller 34 stops rotating, the pressure at the inlet passage 40 increases towards ambient and the ball 80 unseats from seat 82 and moves upstream in its ball cage 84, thus allowing flow of water through the inlet passage 40.

In operation, the drive plate 35 is rotated by the noted motor-driven pulley. This rotates the impeller shaft 36, which in turn causes rotation of the impeller 34. Rotation of the impeller 34 reduces the pressure at the inlet passage 40 and increases the pressure at the first and second outlet passages 44, 46, thus causing flow of water from the inlet conduit 41 through the inlet passage 40 into the pump chamber 32 and out of the first and second outlet passages 44, 46 to the cooling water conduits 48, 50 on the engine 12. In the embodiments shown in FIGS. 2-7, a small amount of cooling water may revert from the chamber 32 to the inlet passage 40 via the drain passage 60. The pressure at the inlet passage 40 is reduced during operation of the impeller 34, thus causing the water that has passed through the drain passage 60 to flow back into the chamber 32 and out of the first and second outlet passages 44, 46 (see FIGS. 5 and 7). Reversion of cooling water in this manner can be limited by the orientation and size of the drain inlet opening 62, structure of the inlet passage 40, including the recess 70, and/or inclusion of one or more check valves 72, as discussed herein above. When the impeller 34 is no longer rotating, water is free to settle in the chamber 32. The drain passage 60 advantageously allows the water to drain out of the chamber 32 to the inlet passage 40, wherein the water can further drain into the inlet conduit 41 and out of the cooling system 10 by conventional means.

What is claimed is:

1. A cooling fluid pump for a cooling a marine engine, the cooling fluid pump comprising a body having a pump chamber that contains an impeller, an upstream inlet passage that supplies cooling fluid to the pump chamber, and a downstream outlet passage that discharges cooling fluid from the pump chamber; an impeller shaft disposed in the body, wherein the impeller shaft rotates the impeller, wherein rotation of the impeller causes flow of cooling fluid through the pump chamber from the upstream inlet passage of the body to the downstream outlet passage of the body; and a drain passage in the body, wherein the drain passage connects the pump chamber to the upstream inlet passage; wherein at least when the impeller is not rotating, the drain passage drains cooling fluid that settles by gravity in the pump chamber back to the upstream inlet passage.

2. A cooling fluid pump for a cooling a marine engine, the cooling fluid pump comprising a pump chamber that contains an impeller, an upstream inlet passage that supplies cooling fluid to the pump chamber; a downstream outlet passage that discharges cooling fluid from the pump chamber; an impeller shaft that rotates the impeller, wherein rotation of the impeller causes flow of cooling fluid through the pump chamber from the upstream inlet passage to the downstream outlet passage; and a drain passage that connects the pump chamber to the upstream inlet passage; wherein at least when the impeller is not rotating, the drain passage drains cooling fluid that settles by gravity in the pump chamber back to the upstream inlet passage, wherein the drain passage has a drain inlet opening and a drain outlet opening, and wherein the drain inlet opening is located in the pump chamber and the drain outlet opening is located in the upstream inlet passage.

3. The cooling fluid pump according to claim 2, wherein the drain inlet opening has a circular cross-section.

4. The cooling fluid pump according to claim 2, wherein operation of the impeller increases pressure at the downstream outlet passage and decreases pressure at the upstream inlet passage; and further comprising a check valve that prevents cooling fluid from draining to the upstream inlet passage through the drain passage during said operation of the impeller.

5. The cooling fluid pump according to claim 4, wherein the check valve is a pressure activated check valve that opens and closes based upon differences between the pressure at the outlet passage and the pressure at the upstream inlet passage.

6. The cooling fluid pump according to claim 5, wherein the check valve comprises a ball and a ball seat.

7. The cooling fluid pump according to claim 2, wherein the impeller has a circumferential upper end and a circumferential lower end and wherein the drain inlet opening is vertically located at or below the circumferential lower end.

8. The cooling fluid pump according to claim 2, wherein the drain passage is made of a different material than the pump chamber.

9. The cooling fluid pump according to claim 2, wherein the upstream inlet passage comprises an inlet opening; wherein the downstream outlet passage comprises an outlet opening; and wherein the inlet opening is vertically located lower than the outlet opening with respect to the pump chamber, and wherein the upstream inlet passage slopes downwardly away from the pump so as to drain cooling fluid from the drain outlet opening.

10. The cooling fluid pump according to claim 9, comprising a recess in the upstream inlet passage, wherein the drain outlet opening is located in the recess.

11. A cooling fluid pump for cooling a marine engine, the cooling fluid pump comprising a body having a pump chamber in which an impeller is driven into rotation by an impeller shaft to pump cooling fluid from an upstream inlet passage in the body supplying cooling fluid to the pump chamber to a downstream outlet passage in the body discharging cooling fluid from the pump chamber; and a drain passage in the body, wherein the drain passage connects the pump chamber to the upstream inlet passage for draining cooling fluid that settles by gravity in the pump chamber back to the upstream inlet passage.

12. The cooling fluid pump according to claim 11, wherein the drain passage has an drain inlet opening that receives the cooling fluid and a drain outlet opening that discharges the cooling fluid, and wherein the drain inlet opening is located higher than the drain outlet opening.

13. The cooling fluid pump according to claim 12, wherein the drain inlet opening is facing downstream with respect to the pump chamber.

14. A cooling fluid pump for cooling a marine engine, the cooling fluid pump comprising a pump chamber in which an impeller is driven into rotation by an impeller shaft to pump cooling fluid from an upstream inlet passage supplying cooling fluid to the pump chamber to a downstream outlet passage discharging cooling fluid from the pump chamber; and a drain passage that connects the pump chamber to the upstream inlet passage for draining cooling fluid that settles by gravity in the pump chamber back to the upstream inlet passage, wherein the upstream inlet passage comprises an inlet volute having a recess formed therein, wherein the drain outlet opening is located in the recess of the inlet volute.

15. A cooling fluid pump for cooling a marine engine, the cooling fluid ump comprising a pump chamber in which an impeller is driven into rotation by an impeller shaft to pump cooling fluid from an upstream inlet passage supplying cooling fluid to the pump chamber to a downstream outlet passage discharging cooling fluid from the pump chamber; and a drain passage that connects the pump chamber to the upstream inlet passage for draining cooling fluid that settles by gravity in the pump chamber back to the upstream inlet passage, wherein the impeller has a circumferential upper end and a circumferential lower end and wherein the inlet opening is vertically located at or below the circumferential lower end so as to drain cooling fluid to a level that is below the impeller.

16. A cooling fluid pump for cooling a marine engine, the cooling fluid pump comprising a pump chamber in which an impeller is driven into rotation by an impeller shaft to pump cooling fluid from an upstream inlet passage supplying cooling fluid to the pump chamber to a downstream outlet passage discharging cooling fluid from the pump chamber; and a drain passage that connects the pump chamber to the upstream inlet passage for draining cooling fluid that settles by gravity in the pump chamber back to the upstream inlet passage, wherein the upstream inlet passage comprises an inlet volute having a wide inlet end that tapers into a narrow outlet end and wherein the downstream outlet passage comprises an outlet volute having a narrow inlet end that tapers into a wide outlet end; and wherein the drain passage connects the narrow inlet end of the outlet volute to the wide inlet end of the inlet volute.

17. The cooling fluid pump according to claim 16, wherein the downstream outlet passage is one of two outlet passages that are oppositely oriented with respect to the impeller.

18. A cooling fluid pump for cooling a marine engine, the cooling fluid pump comprising an upstream inlet passage having an inlet volute that supplies cooling fluid to a pump chamber in which an impeller is driven into rotation by an impeller shaft to pump cooling fluid to a downstream outlet passage having an outlet volute that discharges the cooling fluid; wherein the inlet volute and outlet volute are stacked with respect to each other along an axis along which the impeller shaft extends; and a drain passage that extends from an upstream end of the outlet volute to a downstream end of the inlet volute and is sloped so as to drain cooling fluid that settles by gravity in the pump chamber back to the upstream inlet passage.

19. The cooling fluid pump according to claim 18, wherein the drain passage has an drain inlet opening receiving the cooling fluid and a drain outlet opening discharging the cooling fluid, and wherein the drain inlet opening is located vertically higher than the drain outlet opening; and wherein the drain inlet opening is facing downstream.

20. The cooling fluid pump according to claim 19, wherein operation of the impeller increases pressure at the downstream outlet passage and decreases pressure at the upstream inlet passage; and further comprising a check valve that prevents cooling fluid from draining back to the upstream inlet passage through the drain passage during said operation of the impeller.

* * * * *

UNITED STATES PATENT AND TRADEMARK OFFICE

CERTIFICATE OF CORRECTION

PATENT NO. : 9,254,905 B1
APPLICATION NO. : 13/772088
DATED : February 9, 2016
INVENTOR(S) : Ronnie E. Randolph et al.

It is certified that error appears in the above-identified patent and that said Letters Patent is hereby corrected as shown below:

In the Claims

In claim 12, at column 7, line 67, “an” should instead read --a--.

In claim 15, at column 8, line 21, “ump” should instead read --pump--.

In claim 19, at column 8, line 65, “an” should instead read --a--.

Signed and Sealed this
Third Day of May, 2016

Michelle K. Lee

Michelle K. Lee
*Director of the United States Patent and Trademark Office*